United States Patent [19]

Fournier et al.

[11] Patent Number: 4,934,322

[45] Date of Patent: Jun. 19, 1990

[54] SYSTEM FOR PROTECTING A HEAT-RECOVERY BOILER SCREEN, AND A METHOD OF MANUFACTURING THE SYSTEM

[75] Inventors: Jean Fournier, Rochefort En Yvelines; Adrian Casariego, Velizy Villacoublay, both of France

[73] Assignee: Societe Anonyme dite: Stein Industrie, Velizy Villacoublay, France

[21] Appl. No.: 287,248

[22] Filed: Dec. 21, 1988

[30] Foreign Application Priority Data

Dec. 22, 1987 [FR] France ..... 87 17918

[51] Int. Cl.[5] ..... F22B 37/00

[52] U.S. Cl. ..... 122/6 A; 29/890.034; 29/890.051; 110/339; 122/DIG. 13; 264/35

[58] Field of Search ..... 122/6 A, 511, 512, 510, 122/DIG. 13; 110/338, 339; 29/157.4

[56] References Cited

U.S. PATENT DOCUMENTS 2,368,265 1/1945 Shellenberger et al. ..... 122/6 A 3,675,628 7/1972 Seibold ..... 122/6 R 4,785,769 11/1988 Black ..... 122/6 A

FOREIGN PATENT DOCUMENTS 0228918 7/1987 European Pat. Off. .

409827 5/1934 United Kingdom .

*Primary Examiner*—Edward G. Favors

*Attorney, Agent, or Firm*—Sughrue, Mion, Zinn, Macpeak & Seas

[57] ABSTRACT

A system for protecting a heat-recovery boiler screen, in particular for waste incineration furnaces, said screen being formed by vertical tubes (1, 2) interconnected by welded fixing fins (3, 4, 5) disposed in cavities in refractory bricks (7) and provided with hooking means for refractory bricks. The screen includes windows (6) going through the fixing fins, each brick is provided with at least one hooking lug (8) whose axis is at an angle to the horizontal such that each brick is held suspended by its own weight in one or more windows of the corresponding screen, and the gaps remaining between the bricks, their hooking lugs, and the screen are filled with a refractory cement (9).

7 Claims, 2 Drawing Sheets

SYSTEM FOR PROTECTING A HEAT-RECOVERY BOILER SCREEN, AND A METHOD OF MANUFACTURING THE SYSTEM

The present invention relates to a system for protecting a heat-recovery boiler screen, in particular for waste-incinerating furnaces, said screen being formed by vertical tubes interconnected by welded fixing fins disposed in cavities in refractory bricks and provided with hooking means for engaging the refractory bricks. The invention also extends to a method of manufacturing said system.

BACKGROUND OF THE INVENTION

The Applicants' U.S. patent application No. 160804 filed Feb. 16, 1988 now U.S. Pat. No. 4,809,645 proposes a system for protecting boiler screens constituted by vertical tubes which are interconnected by welded fixing fins, disposed between refractory bricks, and provided with hooking means engaging the refractory bricks, the system being characterized in that the tubes are also provided with vertical auxiliary fins at an angle lying in the range 30° to 60° to the plane of the fixing fins, in that the auxiliary fins are periodically interrupted over vertical lengths of the tubes, in that a first portion of the refractory bricks are provided with vertical notches of width and thickness corresponding to the width and thickness of the auxiliary fins and extending from the bottom over only a fraction of their height, and the other portion with vertical notches extending over their entire height, and in that the bricks of the first portion are hooked onto the top portions of the auxiliary fins and the bricks of the other portion are threaded onto said auxiliary fins above the bricks of the first portion.

Such a system nevertheless requires each tube to be provided not only with junction fins, but also with fins for hooking to bricks, and the system also requires two different types of brick to be provided.

The object of the present invention is to provide a system for protecting boiler screens which does not require brick hooking fins to be welded onto each tube and which makes use of only one type of refractory brick.

SUMMARY OF THE INVENTION

The system of the present invention has a screen which includes windows through the fixing fins, each brick is provided with at least one hooking lug whose axis is at an angle to the horizontal such that each brick is held suspended by its own weight in one or more windows of the corresponding screen, and the gaps remaining between the bricks, their hooking lugs, and the screen are filled with a refractory cement.

The system preferably satisfies at least one of the following characteristics:

the windows in the screen are substantially rectangular in shape, as are the right cross-sections of the hooking lugs of the bricks; and the system further includes metal boxes filled with refractory cement and welded to the screen around each of its windows.

The manufacturing method of the invention is characterized in that longitudinal fins are welded between the vertical tubes, in that windows are cut out in said fins at regular vertical intervals corresponding to the height of the refractory bricks, in that a layer of refractory cement is applied to the surface of the tubes and the fins intended to receive the refractory bricks, and in that each refractory brick is hooked in a window by means of its hooking lug.

When the system includes metal boxes filled with refractory cement, longitudinal fins are welded between the vertical tubes, windows are cut out in said fins at regular vertical intervals corresponding to the height of the refractory bricks, boxes ae applied to the rear faces of the fins around respective ones of the windows, and said boxes are welded to said rear faces, the boxes are filled with refractory cement, a layer of refractory cement is applied to the surface of the tubes and the fins intended to receive the refractory bricks, and each of the refractory bricks is hooked in a window by means of its hooking lug.

Preferably, the windows are cut out in the fins by automatic punching.

BRIEF DESCRIPTION OF THE DRAWINGS

An embodiment of the invention is described by way of example with reference to the accompanying drawings, in which.

MORE DETAILED DESCRIPTION

Figure 1:
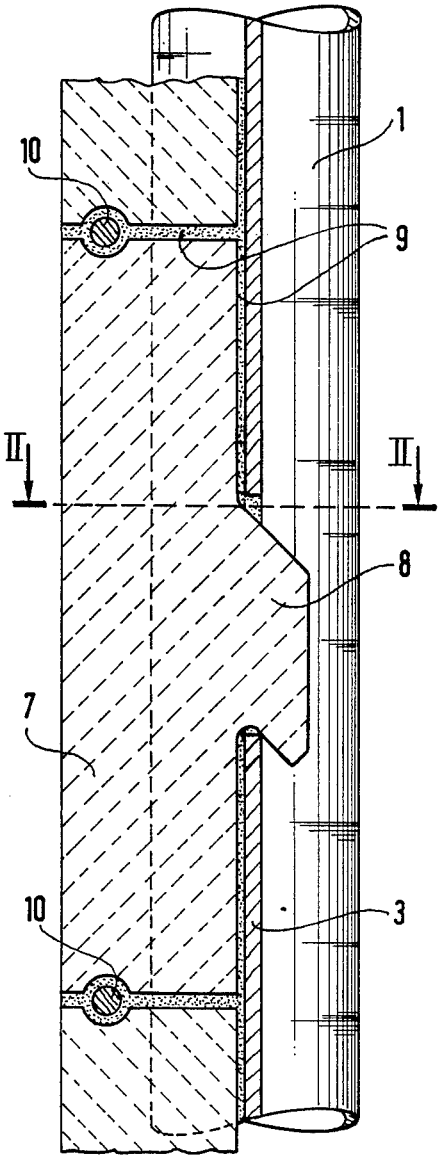
FIG. 1 is a section through a protective system on a vertical plane on line I—I of FIG. 2.
Figure 2:
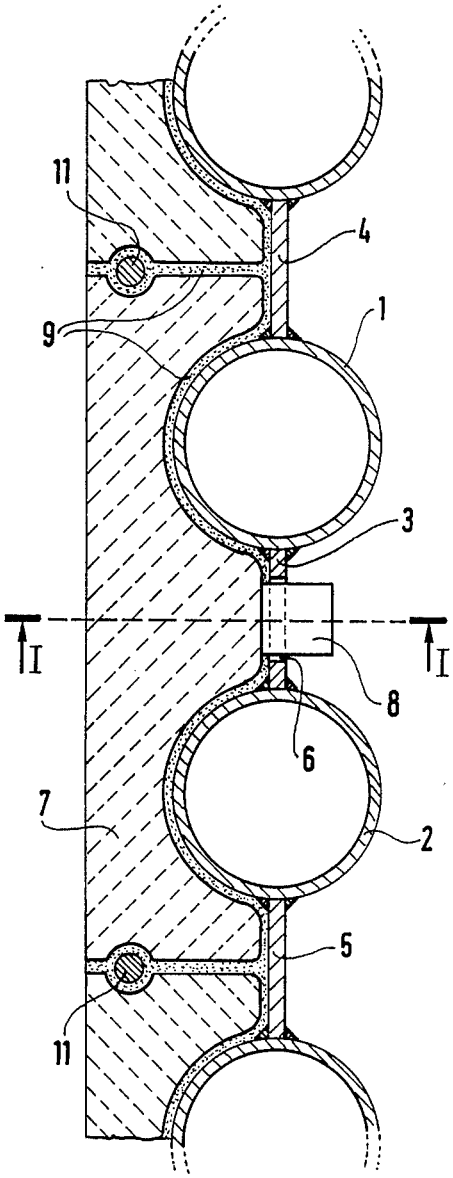
FIG. 2 shows the same system in section on a horizontal plane on line II—II of FIG. 1.

In FIGS. 1 and 2, tubes 1 and 2 and tubes adjacent thereto are interconnected by fins such as 3, 4, and 5 in order to constitute a screen. Fin 3 disposed between the tubes 1 and 2 is pierced at regular vertical intervals by hooking windows for refractory bricks, e.g. made of silicon carbide. Only one window 6 and the corresponding refractory brick 7 are shown. The refractory brick 7 is provided with a hooking lug 8 having an axis at an angle (e.g. 45°) to the horizontal and extending downwards. The window is substantially rectangular in shape and the right cross-section of the hooking lug is also rectangular, being slightly shorter and slightly narrower than the height and the width of the window. A refractory cement 9 is disposed in the gaps remaining between the refractory bricks and between the refractory bricks and the metal screen, in particular inside the window and around its hooking lug.

Between the bricks, horizontal rods such as 10 and vertical rods such as 11 ensure that adjacent bricks are adequately fastened together both vertically, and horizontally.

Figure 3:
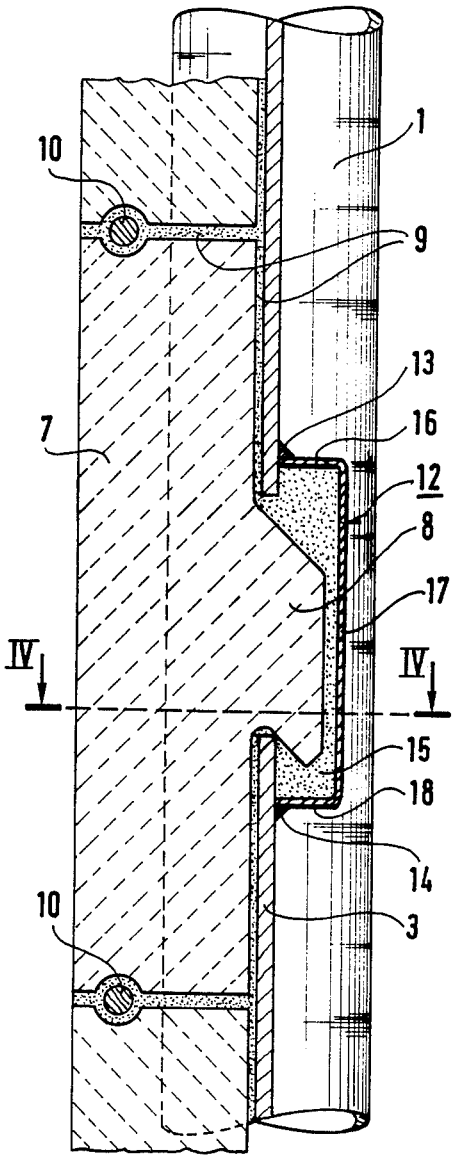
FIG. 3 is a section through a protective system including a metal box disposed behind a window in the screen and engaging the lug of a refractory brick passing through the window, said section being on a vertical plane on line III—III of FIG. 4.
Figure 4:
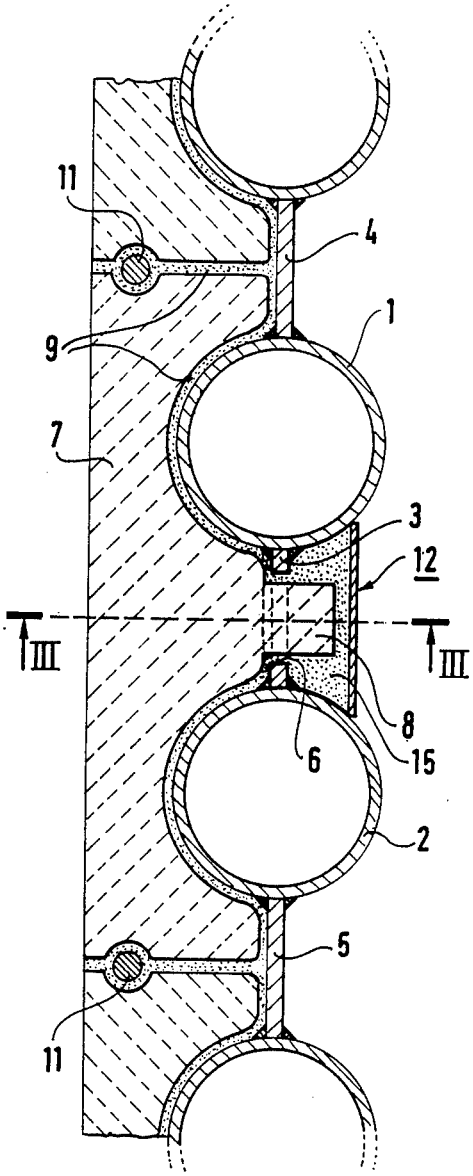
FIG. 4 is a section through the same system having a metal box behind the window of the screen, said section being taken on a horizontal plane on line IV—IV of FIG. 3.

The system shown in FIGS. 3 and 4 is analogous to that shown in FIGS. 1 and 2, but it further includes a metal box 12 welded on the connection fin by weld fillets 13 above the window and 14 beneath the window. This box includes a rear panel 17, a top panel 16, and a bottom panel 18. It presses sideways against the outside of the tubes 1 and 2, thereby constituting a cavity around the hooking lug 8 of the corresponding brick, which cavity is filled with cement. The box may optionally be hooked to the bottom edge of the corresponding window by means of a flat spring-forming blade (not shown).

In order to manufacture the protective system of FIGS. 1 and 2, and after welding the vertical fins into place between the tubes, windows are formed in the fins by automatic punching at regular vertical intervals corresponding to the height of the refractory bricks. A layer of refractory cement having a thickness of a few centimeters is applied on the surface of the fins and the tubes, after which the bricks are hooked in the windows by means of their hooking lugs, with the side faces of the bricks that face one another also being initially provided with a layer of refractory cement. Fastening rods of refractory material 10 and 11 are inserted into the vertical and horizontal channels between the side faces and between the top and bottom faces of the bricks.

When the protective system includes boxes filled with refractory cement for receiving the fastening lugs of the bricks (FIGS. 3 and 4), each box 12 is put into place between its window, optionally after being hooked to the bottom edge of the corresponding window by means of the spring-forming flat blade. The top and bottom faces of the boxes are welded to the corresponding fins by weld fillets and the cavities formed in this way are filled with refractory cement, after which the layers of refractory cement are applied to the tubes and to the fins. As before, the fastening lugs of the refractory bricks are inserted into corresponding windows and layers of cement are applied to the bricks to cover the tubes and the fins The facing side faces of the bricks are provided with layers of refractory cement and rods for holding together adjacent bricks are inserted into the horizontal and vertical channels of the bricks.

We claim:

1. A system for protecting a heat-recovery boiler screen, in particular for waste incineration furnaces, said screen being formed by vertical tubes interconnected by welded fixing fins disposed in cavities in refractory bricks and provided with hooking means for the refractory bricks, the improvement wherein the screen includes windows through the fixing fins, wherein each brick is provided with at least one hooking lug whose axis is at a downwardly oblique angle to the horizontal, said hooking lug extending through said window, such that each brick is held suspended by its own weight in one or more windows, and a refractory cement filling the gaps remaining between the bricks, their hooking lugs, and the screen.

2. A system according to claim 1, wherein the windows in the screen are substantially rectangular in shape, as are the right cross-sections of the hooking lugs of the bricks.

3. A system according to claim 1, further including a metal box welded to the screen around each of said windows on the side of said fins opposite said bricks and filled with refractory cement.

4. A method of manufacturing a system for protecting a heat-recovery boiler screen, in particular for waste incineration furnaces comprising the steps of welding longitudinal fins between vertical tubes to form a screen formed by said vertical tubes interconnected by said welded fins, cutting out windows in said fins at regular vertical intervals corresponding to the height of refractory bricks, said bricks being provided with at least one hooking lug whose axis is at a downwardly oblique angle to the horizontal, applying a layer of refractory cement to the surface of the tubes and the fins intended to receive the refractory bricks, and hooking said hooking lug of each refractory brick in a corresponding window prior to solidification of said refractory cement.

5. The method of manufacturing a system according to claim 4, further comprising the steps of welding boxes to the face of said fins to the side opposite that bearing the refractory bricks, around respective windows and filling said boxes with refractory cement.

6. A method according to claim 4, wherein said step of cutting out the windows in the fins comprises automatic punching of said windows in said fins.

7. A method according to claim 5, wherein said step of cutting out the windows in the fins comprises automatic punching of said windows in said fins.

* * * * *